United States Patent [19]

Kawaguchi et al.

[11] 4,447,757

[45] May 8, 1984

[54] STRUCTURE OF THIN-FILM ELECTROLUMINESCENT DISPLAY PANEL SEALED BY GLASS SUBSTRATES

[75] Inventors: Masashi Kawaguchi, Nara; Toshiaki Ishii; Kinichi Isaka, both of Tenri; Hisashi Uede, Wakayama, all of Japan

[73] Assignee: Sharp Kabushiki Kaisha, Osaka, Japan

[21] Appl. No.: 272,723

[22] Filed: Jun. 11, 1981

[30] Foreign Application Priority Data

Jun. 16, 1980 [JP] Japan ..... 55-81663
May 20, 1981 [JP] Japan ..... 56-77237

[51] Int. Cl.[3] ..... H05B 33/04
[52] U.S. Cl. ..... 313/509; 313/512
[58] Field of Search ..... 313/509, 512; 350/343

[56] References Cited

U.S. PATENT DOCUMENTS 4,037,930 7/1977 Matsuyama et al. ..... 350/343
4,213,074 7/1980 Kawaguchi et al. ..... 313/509
4,226,509 10/1980 Jacobs ..... 350/343
4,357,557 11/1982 Inohara et al. ..... 313/509

*Primary Examiner*—Palmer C. Demeo
*Assistant Examiner*—Sandra L. O'Shea
*Attorney, Agent, or Firm*—Birch, Stewart, Kolasch and Birch

[57] ABSTRACT

A thin electroluminescent (EL) display panel is disclosed which comprises an EL thin film unit for generating an EL light, two glass substrates for sealing the EL thin film unit, a protective liquid filled within a cavity defined by the two glass substrates for protecting the EL thin film unit, a pair of electrodes for conducting electric energy to the EL thin film unit, an injection hole for introducing the protective liquid, the injection hole being sealed, and a covering member for completely covering the sealed injection hole.

5 Claims, 9 Drawing Figures

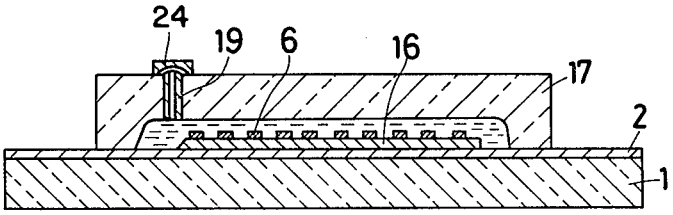
FIG. 1
FIG. 2
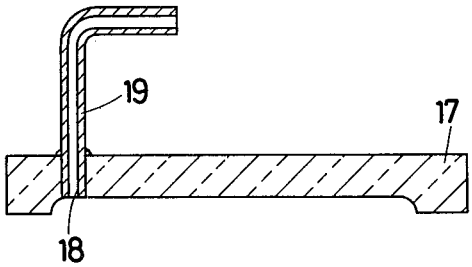
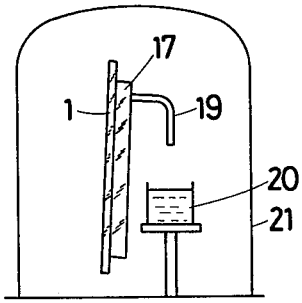
FIG. 3(A)
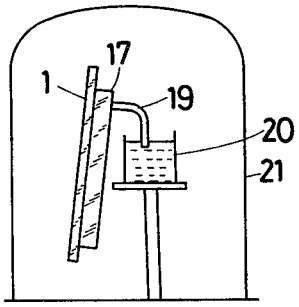
FIG. 3(B)
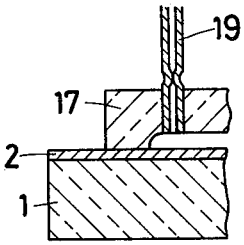
FIG. 4(A)
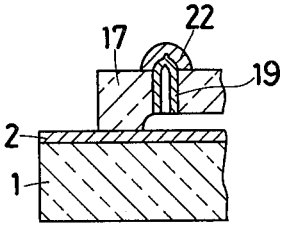
FIG. 4(B)
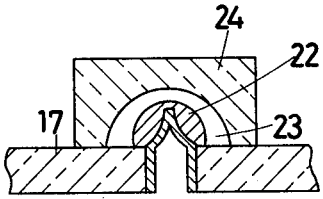
FIG. 4(C)
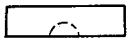
FIG. 5(A)
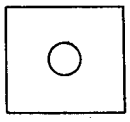
FIG. 5(B)

STRUCTURE OF THIN-FILM ELECTROLUMINESCENT DISPLAY PANEL SEALED BY GLASS SUBSTRATES

BACKGROUND OF THE INVENTION

The present invention relates to an thin-film electroluminescent display panel and, more particularly, to a thin-film electroluminescent display panel shielded by two glass substrates and a protective liquid disposed therebetween.

A conventional thin-film electroluminescent (EL) display panel sealed by two glass substrates and a protective liquid is disclosed in Kawaguchi et al, U.S. Pat. No. 4,213,074 issued July 15, 1980, assigned the common assignee and entitled "THIN-FILM ELECTROLUMINESCENT DISPLAY PANEL SEALED BY GLASS SUBSTRATES AND THE FABRICATION METHOD THEREOF". The disclosure of this patent is incorporated herein by reference.

In the structure of the thin-film EL display panel, it is very important and necessary to completely seal this display panel and, in addition, to prevent any moisture from penetrating into the housing of the display panel defined by the pair of glass substrates. The presence of the moisture mainly lowers the intensity of the EL light from the EL display panel because to the damage of picture elements.

In this respect, the above patented structure of the EL display panel inherently has a defect in that it is rather difficult to make a complete seal including an injection hole for passing a protective liquid therethrough such that the injection hole remains highly resistant to temperature change. Another defect is that moisture from the atmosphere may penetrate into the damaged seal of the injection hole. Moisture can penetrate into a cavity defined by two glass substrates through the damaged seal of the injection hole much easier than through the combined portion between the glass substrates. The cross-sectional size of the injection hole is much greater than that of the beforementioned combined portion of the substrates.

Therefore, it is highly desirable to provide complete seal including the injection hole so as to completely prevent any moisture from the surrounding environment from entering into the inner cavity.

SUMMARY OF THE INVENTION

Accordingly, it is an object of the present invention to provide an improved structure adapted for a thin-film EL display panel sealed by two glass substrates.

It is another object of the present invention to provide an improved seal for an injection hole for introducing a protecting liquid into the respective cavity for protecting a thin-film EL dispaly element.

Briefly described, in accordance with the present invention, a thin electroluminescent (EL) display panel comprises an EL thin film unit for generating an EL light, two glass substrates for sealing the EL thin film unit, a protective liquid filled within a cavity defined by the two glass substrates for protecting the EL thin film unit, a pair of electrodes for conducting electric energy to the EL thin film unit, an injection hole for introducing the protective liquid, the injection hole being sealed, and a covering member for completely covering the sealed injection hole.

BRIEF DESCRIPTION OF THE DRAWINGS

The present invention will become more fully understood from the detailed description given hereinbelow and the accompanying drawings which are given by way of illustration only, and thus are not limitative of the present invention and wherein:

FIG. 1 is a cross-sectional view of a thin-film EL panel according to the present invention;

FIG. 2 is a cross-sectional view of a plate-shaped glass substrate and a tube adapted to the thin-film EL panel shown in FIG. 1.

FIGS. 3(A) and 3(B) are side views of fabrication steps of the thin-film EL panel shown in FIG. 1;

FIGS. 4(A) through 4(C) are cross-sectional views of the fabrication steps of the thin-film EL panel shown in FIG. 1; and FIGS. 5(A) and 5(B) show a front view respectively and a bottom view of a glass cap according to the present invention.

DESCRIPTION OF THE INVENTION

With reference to FIG. 1, the thin EL display panel of the present invention comprises a transparent flat glass substrate 1, a plurality of transparent electrodes 2, a plurality of counter electrodes 6, an EL unit 16, a plate-shaped glass substrate 17, a pipe 19, and a glass cap 24.

The transparent electrodes 2 are made of $In_2O_3$, $SnO_2$, or the like. The counter electrodes 6 are made of a metal such as Al or the like.

The transparent electrodes 2 are arranged on the glass substrate 1 in parallel with each other. The counter electrodes 6 are arranged so that they cross at a right angle relative to the transparent electrodes 2 in a plane view. A cross point between the transparent electrodes 2 and the counter electrodes 6 causes an element for the EL panel. AC energy from a power source (not shown) is applied to the transparent electrodes 2 and the counter electrodes 6.

The EL unit 16 comprises an EL thin film interposed between first and second dielectric layers. The first dielectric-layer comprises $Y_2O_3$, $TiO_2$, $Al_2O_3$, $Si_3N_4$, $SiO_2$, and the like, which is disposed by a sputtering technique or by electron beam evaporation. The EL thin film is made of a ZnS thin film doped with manganese in a desired amount. The second dielectric layer comprises a similar material as that of the first dielectric layer.

The EL panel has a sealing structure for the EL unit, namely, the first and the second dielectric layers and the EL thin film. The substrate 17 is provided for sealing the EL unit together with the transparent glass substrate 1. The substrate 17 is not required to be transparent because viewing is made from the substrate 1.

The plate-shaped glass substrate 17 is tightly bonded by an adhesive of, for example, a photo curing resin, to the transparent glass substrate 1. The detail of the plate-shaped glass substrate 17 is illustrated in FIG. 2. The plate-shaped glass substrate 17 is made of a soda glass having a thickness of 3 mm. A dent 1 mm deep is formed within the plate-shaped glass substrate 17 for locating the EL unit through use of the etching techniques. An injection hole 18 is formed within the plate-shaped glass substrate 17 into which a pipe 19 is inserted for introducing a protective liquid into the cavity defined by the plate-shaped glass substrate 17 and the transparent glass substrate 1. The pipe 19 is made of a metal and is tightly fixed in the injection hole 18.

The protective liquid is contained within a cavity defined by the two substrates 1 and 17. The protective liquid functions to preserve the EL unit. The protective liquid can be silicone oil or grease which are suitable for vacuum sealing.

It is preferable that the protective liquid has the following properties:

(1) capable of penetrating into pin holes appearing in the first and the second dielectric layers;
(2) resistant to a high voltage;
(3) resistant to considerable heat and humidity;
(4) inert with the material of the EL unit; and
(5) has a small vapor pressure and a small coefficient of thermal expassion.

The items (1), (2), and (4) are very important factors for the protective liquid.

The protective liquid is injected into the cavity by the following steps illustrated by FIGS. 3(A), 3(B) and FIGS. 4(A), 4(B) and 4(C).

The EL package comprising the transparent glass substrate 1, the plate-shaped glass substrate 17, and the EL unit is positioned within a vacuum chamber 21. A tank 20 containing the protective liquid is also disposed within the vacuum chamber 21. The pipe 19 is first separate from the protective liquid 13, as shown in FIG. 3(A).

Under these circumstances, the gas within the vacuum chamber 21 is withdraw by a vacuum pump. While the chamber is being evacuated, the tip of the pipe 19 is placed within the protective liquid 13 as shown in FIG. 3(B). There after, the vacuum chamber 21 is returned to atmospheric pressure. The protective liquid contained within the tank 20 is then introduced into the cavity through the pipe 19. The vacuum chamber 21 can be heated to a temperature of one hundred to two hundred degrees centigrade for the purpose of enhanceing the flow properties of the protective liquid.

After the completion of the injection of the protective liquid into the cavity chamber containing the EL device, the pipe 19 is sealed by a pressing bonding technique as shown in FIG. 4(A). The pipe 19 is then cut at the sealed portion. An epoxy adhesive 22 is then coated over the pipe 19 for achieving a complete seal, as shown in FIG. 4(B).

As a feature of the present invention, as viewed from FIG. 4(C), the glass cap 24 is provided for completely covering the adhesive 22 at the pipe cut portion. The glass cap 24 is adhered to the plate-shaped substrate 17 using a photo curing resin, etc. A cavity 23 is formed between the adhesive 22 and the glass cap 24. Thus, the EL display panel is completed. It may not be essential to form the cavity 23, however.

FIGS. 5(A) and 5(B) show a front view and a bottom view respectively of the glass cap 24. The glass cap 24 preferably has a size of 20 mm×20 mm with a thickness of about 3 mm, made of a soda glass as being identical with the material for the plate-shaped glass substrate 17, made of Tempax which is commercially available from Schott Corp. This material is similar to that known as Pyrex glass, or made of Pyrex.

It is preferable to compose the glass cap 24 by using the same material as that of the plate-shaped glass substrate 17.

A dent is formed in the glass cap 24 by sand etching etc. It is formed to make the cavity 23 when assembled to the plate-shaped glass substrate 17.

Each of the materials or components of the thin-film EL display panel and each of their thermal expansion coefficients are summarized as follows:

1. The transparent flat glass substrate 1 made of borosilicate glass:
   thermal expansion coefficient:
   borosilicate glass: about $3.7\times10^{-6}$/°C.
2. The plate-shaped glass substrate 17 made of a soda glass, Tempax, or Pyrex:
   thermal expansion coefficient:
   soda glass: $80\text{–}90\times10^{-7}$/°C.
3. The adhesive 22 may be an expoxy resin such as "TORR SEAL" which is commercially available from the Varian Corp:
   thermal expansion coefficient:
   $5\times10^{-5}$/°C.
4. The photo curing resin, used to bond the substrates 1 and 17, and the substrate 17 and the glass cap 24, is preferably selected to be a resin such as "Photo Bond-100" which is commercially available from MEISEI CHURCHILL Corp.,Japan:
   thermal expansion coefficient: $2\times10^{-4}$/°C.
5. The glass cap 24 is made of a soda glass, Tempax, or Pyrex:
   thermal expansion coefficient:
   soda glass: $80\text{–}90\times10^{-7}$/°C.
   Tempax or Pyrex: about $3.2\times10^{-6}$/°C.
6. The protective liquid composed of silicone oil:
   thermal expansion coefficient:
   $7.5\times10^{-4}$/°C.

From the summary as described above, it should be evident that the thermal expansion coefficient of the adhesive 22 is much greater than any glass material such as a soda glass, Tempax, or Pyrex. As the temperature increases, this may lead to the breaking of the adhesive 22 and the leaking of the protective liquid, which can thermally expand, through the reopened adhesive 22.

According to the present invention, the glass cap 24 is provided for completely sealing off any of the leaked protective liquid. For this purpose, the cavity 23 is formed so as to contain the leaked protective liquid. The photo curing resin such as "Photo Bond-100" is flexible and resistant to strain caused by thermal expansion so that it can absorb such strain.

Additionally, since the sealed injection hole is completely covered by the glass cap 24, moisture is prevented from being introduced from the atmosphere to the inner side of the cavity of the EL display panel. It may occur that any moisture can penetrate into the panel through the combined portions between the substrates 1 and 17, and between the substrate 17 and the glass cap 24, if the sealed injection hole is reopened. However, these portions are very thin as in the order of a so as to prevent any moisture introduction therethrough.

Therefore, moisture can be eliminated from the EL panel embodying the present invention.

While only certain embodiments of the present invention have been described, it will be apparent to those skilled in the art that various changes and modifications may be made therein without departing from the spirit and scope of the invention as claimed.

What is claimed is:

1. A thin film electroluminescent display panel comprising:

first and second substrates disposed so as to define a cavity therebetween;

a composite comprising a thin-film electroluminescent layer interpositioned between a pair of dielectric layers, said composite being disposed within said cavity, at least one of said first and second substrates being transparent to light emitted by said electroluminescent layer when said layer is stimulated;

a pair of opposing electrodes positioned so as to sandwich said composite therebetween;

a protective liquid provided within said cavity defined by said substrates and being in contact with said dielectric layers;

an injection hole formed in at least one of said first and second substrates for introducing said protective liquid into said cavity, said substrate in which said injection hole is formed being glass, said injection hole being sealed; and a glass covering means for completely covering said sealed injection hole.

2. The display panel of claim 1, wherein said first and second substrate comprise a transparent plane glass substrate and a plate-shaped glass substrate respectively, and said injection hole is formed in said plate-shaped glass substrate.

3. The element of claim 1, wherein the protective liquid is silicone oil.

4. The element of claim 1, wherein the protective liquid is grease.

5. A thin electroluminescent display panel comprising:

first and second substrates disposed so as to define a cavity therebetween;

a composite comprising a thin-film electroluminescent layer interpositioned between a pair of dielectric layers, said composite being disposed within said cavity, at least one of said first and second substrates being transparent to light emitted by said electroluminescent layer when said layer is stimulated;

a pair of opposing electrodes positioned so as to sandwich said composite therebetween;

a protective liquid provided with said cavity defined by said substrates and being in contact with said dielectric layers;

an injection hole formed in at least one of said first and second substrates for introducing said protective liquid into said cavity, said substrate in which said injection hole is formed being glass, said injection hole being sealed; and a glass covering means for completely covering said sealed injection hole such that a compartment is formed between said sealed injection hole and said covering means.

* * * * *